US010796625B2

(12) United States Patent
Zhou

(10) Patent No.: US 10,796,625 B2
(45) Date of Patent: Oct. 6, 2020

(54) PIXEL CIRCUIT HAVING DUAL-GATE TRANSISTOR, AND DRIVING METHOD AND DISPLAY THEREOF

(71) Applicant: EverDisplay Optronics (Shanghai) Limited, Shanghai (CN)

(72) Inventor: Xingyu Zhou, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 119 days.

(21) Appl. No.: 15/984,808

(22) Filed: May 21, 2018

(65) Prior Publication Data

US 2018/0342195 A1 Nov. 29, 2018

(30) Foreign Application Priority Data

May 23, 2017 (CN) ..... 2017 1 0369249

(51) Int. Cl.
*G09G 3/3233* (2016.01)
*G09G 3/22* (2006.01)

(52) U.S. Cl.
CPC ..... *G09G 3/22* (2013.01); *G09G 3/3233* (2013.01); *G09G 2300/0819* (2013.01); *G09G 2300/0842* (2013.01); *G09G 2300/0861* (2013.01); *G09G 2310/0243* (2013.01); *G09G 2310/0251* (2013.01); *G09G 2310/0262* (2013.01);
(Continued)

(58) Field of Classification Search
None
See application file for complete search history.

(56) References Cited

U.S. PATENT DOCUMENTS

2006/0244695 A1* 11/2006 Komiya ..... G09G 3/006 345/76
2011/0109531 A1 5/2011 Choi
(Continued)

FOREIGN PATENT DOCUMENTS

CN 1874627 A 12/2006
CN 103137067 A 6/2013
CN 104167173 A 11/2014
(Continued)

OTHER PUBLICATIONS

The CN1OA issued Jan. 4,2019 by the CNIPA.

*Primary Examiner* — Amr A Awad
*Assistant Examiner* — Donna V Lui
(74) *Attorney, Agent, or Firm* — Yunling Ren

(57) ABSTRACT

The present disclosure discloses a pixel circuit, a driving method and a display, including: a compensation unit connected with a driving unit; an external power supply, a driving unit and a first light emitting unit sequentially connected in series; a capacitor disposed between a first node and the external power supply; and an initialization unit with a first initialization transistor having a first electrode of connected to the first node, a gate electrode externally connected to a second scan signal, and a second electrode connected to a second light emitting unit, and a second initialization transistor having a first electrode connected to the second light emitting unit, a second electrode connected to an initialization voltage and a gate electrode externally connected to a second scan signal. The first initialization transistor and the second initialization transistor are a dual-gate transistor.

8 Claims, 13 Drawing Sheets

(52) U.S. Cl.
CPC ..... *G09G 2310/0264* (2013.01); *G09G 2320/043* (2013.01)

(56) References Cited

U.S. PATENT DOCUMENTS

| | | | | |
|---|---|---|---|---|
| 2016/0351121 | A1* | 12/2016 | Kim | G09G 3/3233 |
| 2018/0137817 | A1* | 5/2018 | Wu | G09G 3/3258 |

FOREIGN PATENT DOCUMENTS

| | | | |
|---|---|---|---|
| CN | 105702186 | A | 6/2016 |
| CN | 106205493 | A | 12/2016 |

* cited by examiner

S901 in an initialization stage, the second scan signal is controlled to turn on the first initialization transistor and the second initialization transistor. The first initialization transistor initializes the first node with an initialization voltage, the second initialization transistor initializes the second light emitting unit with the initialization voltage. The capacitor maintains the initialization voltage. The first scan signal is controlled to turn off the compensation unit and the first control signal is controlled to turn off the driving unit

S902 in a data writing stage, controlling the first scan signal to turn on the compensation unit, and the compensation unit setting the voltage of the first node to the first voltage; controlling the first control signal to turn off the driving unit, so that the first light emitting unit does not emit light, controlling the second scan signal to turn off the first initialization transistor and the second initialization transistor; the capacitor maintaining the voltage of the first node at the first voltage; wherein, the first voltage is resulted from the voltage of the data signal being compensatedby a compensation transistor in the compensation unit

S903 in a light emitting stage, the first scan signal is controlled to turn off the compensation unit, the second scan signal is controlled to turn off the first initialization transistor and the second initialization transistor, and the first control signal is controlled to turn on the driving unit. The driving unit generates a driving current to drive the first light emitting unit to emit light; the driving current is obtained based on the first voltage, the external power supply, and the threshold voltage of the driving transistor in the driving unit; and the capacitor is in the maintaining state

Fig.9

PIXEL CIRCUIT HAVING DUAL-GATE TRANSISTOR, AND DRIVING METHOD AND DISPLAY THEREOF

CROSS REFERENCE

This application is based upon and claims priority to Chinese Patent Application No. 201710369249.3, filed on May 23, 2017, the entire contents thereof are incorporated herein by reference.

TECHNICAL FIELD

The present disclosure relates to the field of electronic display technologies, and in particular, to a pixel circuit, a driving method, and a display.

BACKGROUND

In a conventional pixel circuit, a light emitting diode in a pixel circuit is generally driven by a thin film transistor. Such thin film transistor is called a driving transistor. The driving transistor operates in a saturated state because in the saturation state, the driving current output from the driving transistor is less sensitive to the source-drain voltage than the driving transistor in the linear state, and can provide a more stable driving current for the light emitting diode. FIG. 1 illustrates a general conventional pixel circuit in the related art. As shown in FIG. 1, the pixel circuit is composed of two transistors T11 and T12 and a capacitor C11. When the transistor T12 is turned on under the control of a signal Sn, a data signal data is written into a node N1 to charge the capacitor C11 while turning on the driving transistor T11. The driving current generated by the transistor T11 causes a light emitting diode EL11 between a first power source ELVDD and a second power source ELVSS to emit light. The driving current $I_{EL}$ is shown as in Equation 1.

$$I_{EL} = \frac{1}{2}\mu C_{OX}\frac{W}{L}(V_{GS} + V_{TH})^2 \quad \text{(Equation 1)}$$

Where, μ denotes a carrier mobility rate, $C_{ox}$ denotes a gate oxide capacitance per unit area of T11, L denotes a channel length of T11, W denotes a gate width of T11, $V_{GS}$ denotes a gate-source voltage of T11, and $V_{TH}$ denotes a threshold voltage of T11. From Equation 1, it can be seen that the magnitude of the driving current is related to the threshold voltage of T11. However, due to the existence of the threshold drift phenomenon, the threshold voltage of the driving transistor T11 is not stable, and thus the driving current drifts, causing the brightness of the light emitting diode to be uneven.

In order to solve the above problem, designers have studied a series of circuits that can eliminate the influence of the threshold drift of the driving transistor, which is called a threshold compensation circuit. FIG. 2 is a conventional threshold compensation circuit. As shown in FIG. 2, in a data writing stage, the signal Sn turns on the transistors T22 and T23 to short-circuit the gate electrode and the drain electrode of the driving transistor T21, and at the same time, the signal En turns off the transistor T25, the signal Sn-1 turns off the transistor T24, and the data signal data is input to the source electrode of T21 via T22. Since the gate electrode and the drain electrode of T21 are short-circuited at this time, the data signal is transmitted to the gate electrode of T21 via the drain electrode of T21, and the capacitor C21 starts to store charge so that the gate voltage of T22 gradually decreases to ($V_{data}$+$V_{TH}$). After that, T21 enters an off state, and C21 stops charging. In a light emitting stage, the transistor T25 is turned on under the control of a signal En, and a signal Sn-1 turns off the transistor T24, a signal Sn turns off the transistors T22 and T23, and the power source ELVDD is transmitted to the driving transistor T21 via the transistor T25. At this time, the driving transistor generates a driving current as shown in Equation 2.

$$I_{EL} = \frac{1}{2}\mu C_{OX}\frac{W}{L}(V_{ELVDD} - V_{data})^2 \quad \text{(Equation 2)}$$

From Equation 2, it can be seen that the magnitude of the driving current is no longer related to the threshold voltage of the driving transistor T21.

However, in the conventional threshold compensation circuit represented by FIG. 2, during a data writing stage, only a transistor T25 is interposed between the power source ELVDD and the data signal, since the voltage of the power source ELVDD is much higher than other signal voltages, and a leakage current of the T25 exists, the data signal is highly vulnerable to the influence of the power source ELVDD, thereby reducing light emitting stability of the light emitting diode. In addition, the circuit is composed of a plurality of transistors, which has a complicated configuration and a high cost.

In summary, in the related art, there is a problem that light emission of the light emitting diode is unstable and the circuit configuration is complicated.

SUMMARY

The present disclosure provides a pixel circuit, a driving method, and a display to solve the problem that light emission of the light emitting diode is unstable and the circuit configuration is complicated for the conventional pixel circuit.

An embodiment of the present disclosure provides a pixel circuit, including: a compensation unit, a driving unit, a first light emitting unit, a second light emitting unit, an initialization unit, a capacitor, and an external power supply;

wherein the compensation unit is electrically connected to the driving unit through a first node; the external power supply, the driving unit, and the first light emitting unit are sequentially connected in series; the capacitor is disposed between the first node and the external power supply; the initialization unit includes a first initialization transistor and a second initialization transistor, a first electrode of the first initialization transistor is electrically connected to the first node, and a gate electrode of the first initialization transistor is externally connected to a second scan signal, a second electrode of the first initialization transistor is electrically connected to the second light emitting unit, a first electrode of the second initialization transistor is electrically connected to the second light emitting unit, a second electrode of the second initialization transistor is externally connected to an initialization voltage, a gate electrode of the second initialization transistor is externally connected to the second scan signal, the first initialization transistor and the second initialization transistor are a dual-gate transistor;

the compensation unit is externally connected to the data signal and a first scan signal, and the compensation unit is configured to, under the effect of the first scan signal, set the voltage of the first node to a first voltage which is resulted from the voltage of the data signal being compensated by a compensation transistor in the compensation unit;

the capacitor is configured to maintain the voltage of the first node at the first voltage;

the driving unit is externally connected to a first control signal, the driving unit is configured to generate a driving current which would drive the light emitting unit to emit light according to the first control signal, the driving current is obtained according to the first voltage, the external power supply and a threshold voltage of a driving transistor in the driving unit, and the driving transistor and the compensation transistor are a common-gate transistor; and the initialization unit is configured to turn on the first initialization transistor and the second initialization transistor under the control of the second scan signal, thereby initializing the first node and the second light emitting unit with an initialization voltage.

Optionally, the driving transistor and the compensation transistor are mirror transistors.

Optionally, the second light emitting unit is a first light emitting unit of an adjacent pixel circuit or the first light emitting unit of the same pixel.

Optionally, the compensation unit includes a data strobe transistor and a compensation transistor;

a first electrode of the data strobe transistor is electrically connected to a second electrode of the compensation transistor, a second electrode of the data strobe transistor is externally connected to the data signal, a gate electrode of the data strobe transistor is externally connected to the first scan signal, a first electrode of the compensation transistor is electrically connected to a gate electrode of the compensation transistor, and a gate electrode of the compensation transistor is electrically connected to the driving unit through the first node;

the compensation unit is configured to turn on the data strobe transistor through the first scan signal, so that the compensation transistor sets the voltage of the first node to the first voltage which is resulted from the voltage of the data signal being compensated by a compensation transistor in the compensation unit.

Optionally, the compensation unit further includes a switch transistor;

a first electrode of the switch transistor is electrically connected to a gate electrode of the compensation transistor, a second electrode of the switch transistor is electrically connected to a first electrode of the compensation transistor, and a gate electrode of the switch transistor is externally connected to the first scan signal, and the switch transistor is configured to turn on or turn off the compensation transistor according to the first scan signal.

Optionally, the driving unit includes a driving transistor and a light emitting control transistor;

a first electrode of the driving transistor is externally connected to the first power supply; a gate electrode of the driving transistor is electrically connected to the compensation unit; and a second electrode of the driving transistor is electrically connected to a first electrode of the light emitting control transistor; and a second electrode of the light emitting control transistor is electrically connected to the first light emitting unit, and a gate electrode of the light emitting control transistor is externally connected to the first control signal.

Optionally, the driving unit includes a driving transistor and a light emitting control transistor:

a first electrode of the light emitting control transistor is externally connected to the first power supply; a second electrode of the light emitting control transistor is electrically connected to a first electrode of the driving transistor, and a gate electrode of the light emitting control transistor is externally connected to the first control signal; and a gate electrode of the driving transistor is electrically connected to the compensation unit, and a second electrode of the driving transistor is electrically connected to the first light emitting unit.

An embodiment of the present disclosure provides a pixel circuit driving method applied to the abovementioned pixel circuit, including:

in an initialization stage, controlling the second scan signal to turn on the first initialization transistor and the second initialization transistor, the first initialization transistor initializing the first node with an initialization voltage, the second initialization transistor initializing the second light emitting unit with the initialization voltage, the capacitor maintaining the initialization voltage, controlling the first scan signal to turn off the compensation unit and controlling the first control signal to turn off the driving unit;

in a data writing stage, controlling the first scan signal to turn on the compensation unit, and the compensation unit setting the voltage of the first node to the first voltage; controlling the first control signal to turn off the driving unit, so that the first light emitting unit does not emit light, controlling the second scan signal to turn off the first initialization transistor and the second initialization transistor; the capacitor maintaining the voltage of the first node at the first voltage; wherein, the first voltage is resulted from the voltage of the data signal being compensated by a compensation transistor in the compensation unit;

in a light emitting stage, controlling the first scan signal to turn off the compensation unit; controlling the second scan signal to turn off the first initialization transistor and the second initialization transistor, and controlling the first control signal to turn on the driving unit, the driving unit generating a driving current to drive the first light emitting unit to emit light; wherein the driving current is obtained based on the first voltage, the external power supply, and the threshold voltage of the driving transistor in the driving unit; and the capacitor is in the maintaining state.

Optionally, controlling the first scan signal to turn on the compensation unit includes:

controlling the first scan signal to turn on the data strobe transistor or the switch transistor.

An embodiment of the present disclosure provides a display including the above pixel circuit.

In summary, an embodiment of the present disclosure provides a pixel circuit, a driving method and a display. The pixel circuit includes a compensation unit, a driving unit, a first light emitting unit, a second light emitting unit, an initialization unit, a capacitor and an external power supply. The compensation unit is electrically connected to the driving unit through the first node. The external power supply, the driving unit and the first light emitting unit are sequentially connected in series. The capacitor is disposed between the first node and the external power supply. The initialization unit includes a first initialization transistor and a second initialization transistor. The first electrode of the first initialization transistor and the first node is electrically connected, the gate electrode of the first initialization transistor is externally connected to the second scan signal, the second electrode of the first initialization transistor is electrically connected to the second light emitting unit, and the first electrode of the second initialization transistor is electrically connected to the second light emitting unit. The second electrode of the initialization transistor is externally connected to an initialization voltage, and the gate electrode of the second initialization transistor is connected to the second scan signal; the first initialization transistor and the second initialization transistor are a dual-gate transistor; and the compensation unit is externally connected to the data signal and the first scan signal. The compensation unit is configured to set the voltage of the first node as the first voltage under the effect of the first scan signal. The first voltage is resulted from the voltage of the data signal being compensated by a compensation transistor in the compensation unit. The capacitor is configured to maintain the voltage of the first node at the first voltage. The driving unit is externally connected to a first control signal, and the driving unit is configured to generate a driving current to drive the light emitting unit to emit light according to the first control signal. The driving current is obtained according to the first voltage, an external power supply and a threshold voltage of a driving transistor in the driving unit. The driving transistor and the compensation transistor are a common-gate transistor. The initialization unit is configured to turn on the first initialization transistor and the second initialization transistor under the control of the second scan signal, and initialize the first node and the second light emitting unit with the initialization voltage. The compensation unit is externally connected to the data signal, and the driving unit is externally connected to the external power source, so that in the data writing stage, the data signal is compensated by the compensation transistor in the compensation unit, and the threshold voltage of the compensation transistor is compensated to the voltage of the data signal to obtain the first voltage. Since the compensation unit is not connected to the external power supply, the influence of the external power supply on the data signal can be avoided. Moreover, the driving transistor and the compensation transistor are a common-gate transistor, and both have the same change in threshold voltage. Therefore, compensating the threshold voltage of the compensation transistor to the data signal is equivalent to compensating the threshold voltage of the driving transistor to the voltage of the data signal. This can ensure the threshold compensation function of the pixel circuit. Therefore, in the embodiments of the present disclosure, the threshold compensation function of the pixel circuit can be achieved while the e influence of the external power supply on the data signal can be avoided, thus improving the light emitting stability of the light-emitting diode. In addition, in the initialization unit, the first initialization transistor and the second initialization transistor are a dual-gate transistor, instead of two initialization transistor, thereby simplifying the circuit configuration and reducing the cost for the circuit.

BRIEF DESCRIPTION OF THE DRAWINGS

In order to more clearly illustrate the technical solutions in the embodiments of the present disclosure, the drawings used in the description of the embodiments are briefly described below. Apparently, the drawings in the following description are merely some embodiments of the present disclosure. Those skilled in the art can also obtain other drawings based on these drawings without any creative effort.

FIG. 9 is a flowchart illustrating a driving method for a pixel circuit according to an embodiment of the present disclosure;

DETAILED DESCRIPTION

Figure 1:
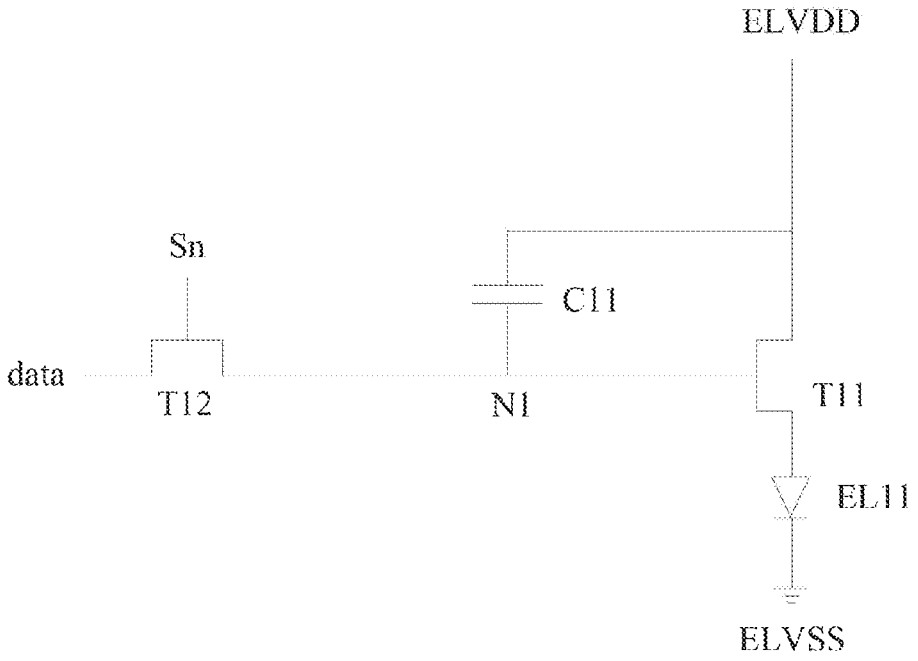
Fig.1 (Prior Art)
FIG. 1 illustrates a general conventional pixel circuit in the related art.
Figure 2:
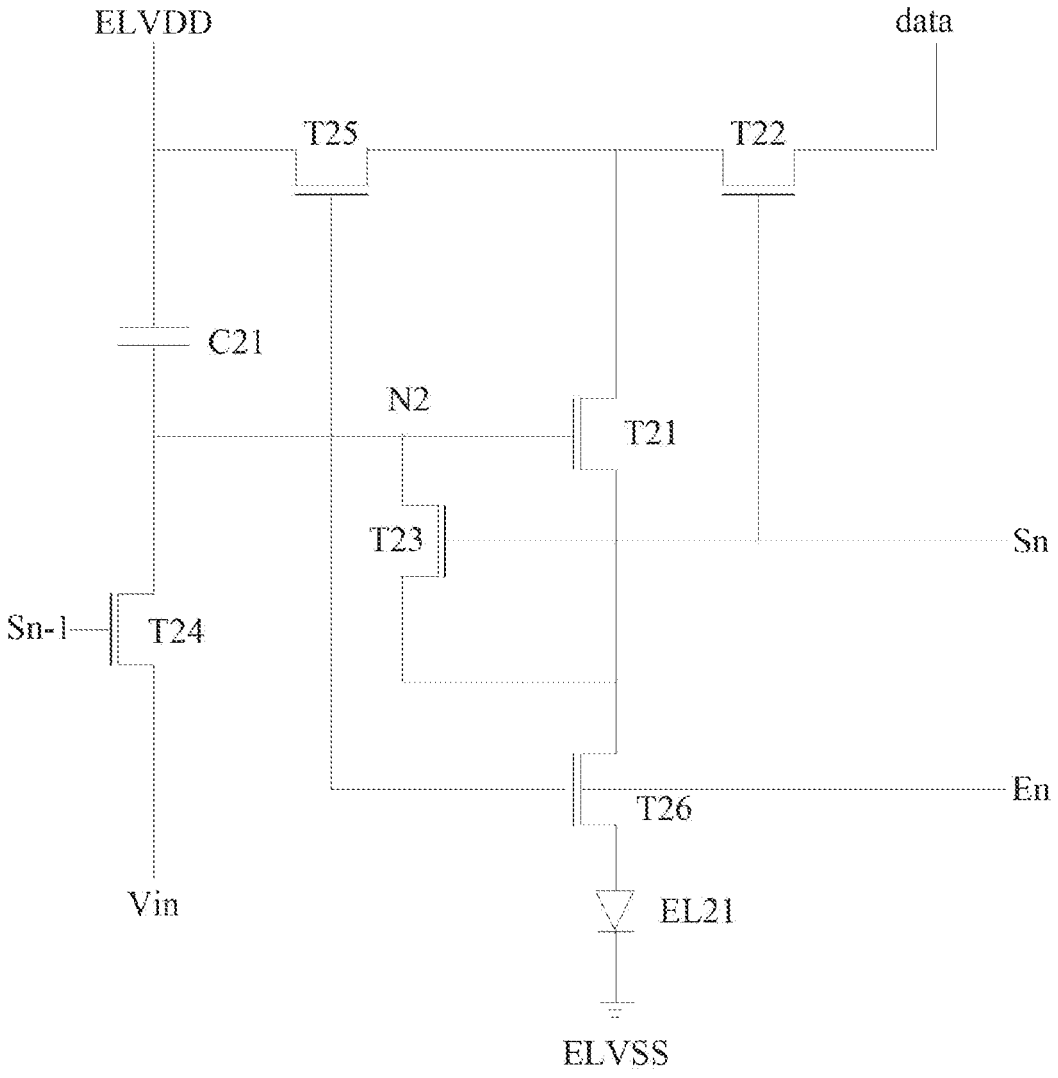
Fig.2 (Prior Art)
FIG. 2 illustrates a conventional threshold compensation circuit.

To make the objectives, technical solutions, and advantages of the present disclosure clearer, the present disclosure will be further described in detail below with reference to the accompanying drawings. Apparently, the described embodiments are merely some but not all of the embodiments of the present disclosure. All other embodiments obtained by a person of ordinary skill in the art based on the embodiments of the present disclosure without creative effort shall fall within the protection scope of the present disclosure.

An embodiment of the present disclosure discloses a pixel circuit including: a compensation unit, a driving unit, a first light emitting unit, a second light emitting unit, an initialization unit, a capacitor, and an external power supply. The compensation unit is electrically connected to the driving unit through a first node. The external power supply, the driving unit and the first light emitting unit are sequentially connected in series. The capacitor is disposed between the first node and the external power supply. The initialization unit includes a first initialization transistor and a second initialization transistor. A first electrode of the first initialization transistor is electrically connected to t first node. A gate electrode of the first initialization transistor is externally connected to a second scan signal. A second electrode of the first initialization transistor is electrically connected to the second light emitting unit. A first electrode of the second initialization transistor is electrically connected to the second light emitting unit. A second electrode of the second initialization transistor is externally connected to an initialization voltage. A gate electrode of the second initialization transistor is externally connected to the second scan signal. The first initialization transistor and the second initialization transistor are a dual-gate transistor. The compensation unit is externally connected to the data signal and a first scan signal. The compensation unit is configured to, under the effect of the first scan signal, set the voltage of the first node to a first voltage which is resulted from the voltage of the data signal being compensated by a compensation transistor in the compensation unit. The capacitor is configured to maintain the voltage of the first node at the first voltage. The driving unit is externally connected to a first control signal, and the driving unit is configured to generate a driving current to drive the light emitting unit to emit light according to the first control signal. The driving current is obtained according to the first voltage, an external power supply and a threshold voltage of a driving transistor in the driving unit. The driving transistor and the compensation transistor are a common-gate transistor. The initialization unit is configured to turn on the first initialization transistor and the second initialization transistor under the control of the second scan signal, and initialize the first node and the second light emitting unit with the initialization voltage.

Figure 3:
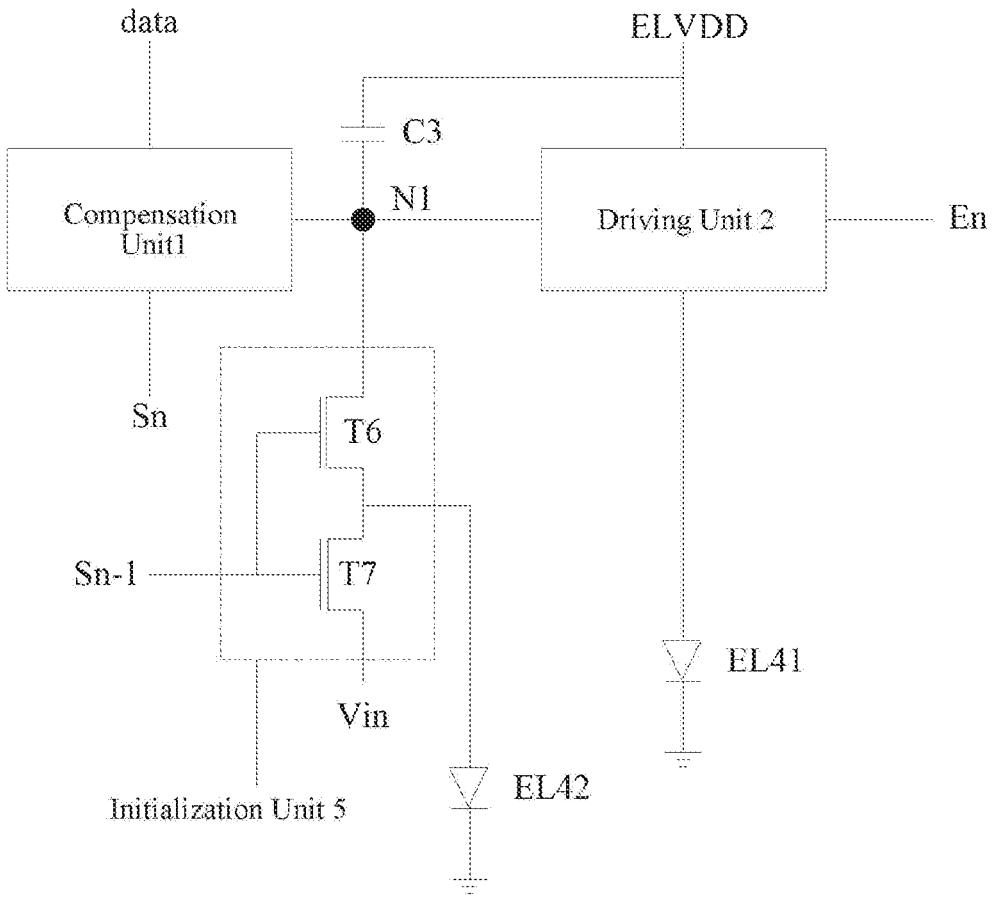
FIG. 3 is a schematic diagram of a pixel circuit according to an embodiment of the present disclosure.

FIG. 3 is a schematic diagram of a pixel circuit according to an embodiment of the present disclosure. As shown in FIG. 3, the pixel circuit includes a compensation unit 1, a driving unit 2, a first light emitting unit EL41, a second light emitting unit EL42, and an initialization unit 5, a capacitor C3 and an external power supply ELVDD. The compensation unit 1 is electrically connected to the driving unit 2 through the first node N1. The external power supply ELVDD, the driving unit 2, and the first light emitting unit EL41 are sequentially connected in series. The capacitor C3 is disposed between a first node N3 and the external power supply ELVDD. The initialization unit 5 includes a first initialization transistor T6 and a second initialization transistor T7. A first electrode of the first initialization transistor T6 is electrically connected to the first node N1, a gate electrode of the first initialization transistor T6 is externally connected to a second scan signal Sn-1, and a second electrode of the first initialization transistor T6 is electrically connected to the second light emitting unit EL42. A first electrode of the second initialization transistor T7 is electrically connected to the second light emitting unit EL42, and a second electrode of the second initialization transistor T7 is externally connected to an initialization voltage Vin, and a gate electrode of the second initialization transistor T7 is connected to the second scan signal Sn-1. The first initialization transistor T6 and the second initialization transistor T7 are a dual-gate transistor. The compensation unit 1 is externally connected to the data signal data and the first scan signal Sn. When the compensation unit 1 is turned on through the first scan signal, the compensation unit 1 sets the voltage of the first node N1 to the first voltage, i.e. ($V_{data}$+ $V_{thT1}$), where $V_{thT1}$ denotes a threshold voltage of the compensation transistor T1. The capacitor C3 is configured to maintain the voltage of the first node N1 at the first voltage. The driving unit 2 is externally connected to a first control signal En. When the driving unit 2 is turned on through the first control signal En, the driving unit 2 generates a driving current to drive the first light emitting unit EL41 to emit light. The driving current is obtained according to the first voltage, the external power supply ELVDD, and the threshold voltage of the driving transistor in the driving unit 2. The driving transistor and the compensation transistor are a common-gate transistor. When the second scanning signal Sn-1 controls the initialization unit 5, the first initialization transistor T6 and the second initialization transistor T7 are turned on, and the first node N1 and the second light emitting unit EL42 are initialized with the initialization voltage Vin.

From the equation 1, it can be seen that when the first control signal En controls the driving unit 2 to be turned on, the magnitude of the driving current $I_{EL4}$ flowing through the first light emitting unit EL41 is as shown in Equation 3:

$$I_{EL4} = \frac{1}{2}\mu C_{OX}\frac{W}{L}(V_{ELVDD} - V_{N1} + V_{thT2})^2 \quad \text{(Equation 3)}$$

Where, $V_{ELVDD}$ denotes the voltage of the external power source ELVDD, and $V_{N1}$ denotes the first voltage, which is the threshold voltage of the driving transistor. Since the driving transistor is the common-gate transistor of the compensation transistor T1, the threshold voltage of the driving transistor and the threshold voltage of the compensation transistor T1 have the same change, that is, $V_{thT1}-V_{thT2}=A$, where A is a constant. Thus, Equation 3 can be further transformed into:

$$I_{EL} = \frac{1}{2}\mu C_{OX}\frac{W}{L}(V_{ELVDD} - V_{data} - A)^2 \quad \text{(Equation 4)}$$

Thus, the influence of the threshold current of the driving transistor on the light emitting diode is eliminated. In addition, in the pixel circuit shown in FIG. 3, the data signal data is input to a data strobe transistor T3 in the compensation unit 1, and the ELVDD is connected to the driving unit 2, so that the data signal data is written into the first node N1 through the compensation transistor T1 during the data writing stage. During the light emitting stage. ELVDD is connected to the driving unit 2, and the data signal data and the external power source ELVDD are isolated from each other, thereby avoiding the influence of the external power source ELVDD on the data signal data, and improving the light emitting stability of the light emitting transistor. In addition, the first initialization transistor T6 and the second initialization transistor T7 are replaced by one dual-gate transistor, thereby simplifying the circuit configuration and reducing the cost for the circuit.

Optionally, the driving transistor and the compensation transistor are mirror transistors, and both have the same threshold voltage, i.e. $V_{thT1}=V_{thT2}$, the Equation 4 can be further simplified to the relationship shown in Equation 2.

Optionally, in FIG. 3, the second light emitting unit EL42 is the first light emitting unit of an adjacent pixel circuit of the pixel array where the pixel circuit shown in FIG. 3 is located. In the display, a plurality of pixel circuits are arranged in the form of a pixel array. Due to the layout of the circuit, the distance from the initialization unit of a pixel circuit to the first light emitting unit of the instant circuit is longer than the distance to the first light emitting unit of the pixel circuit in the next or previous level. The initialization unit is connected to the first light emitting unit of the pixel circuit in the next or previous level, which can reduce the wiring in the pixel array and make the pixel array structure more concise and clear.

Figure 4:
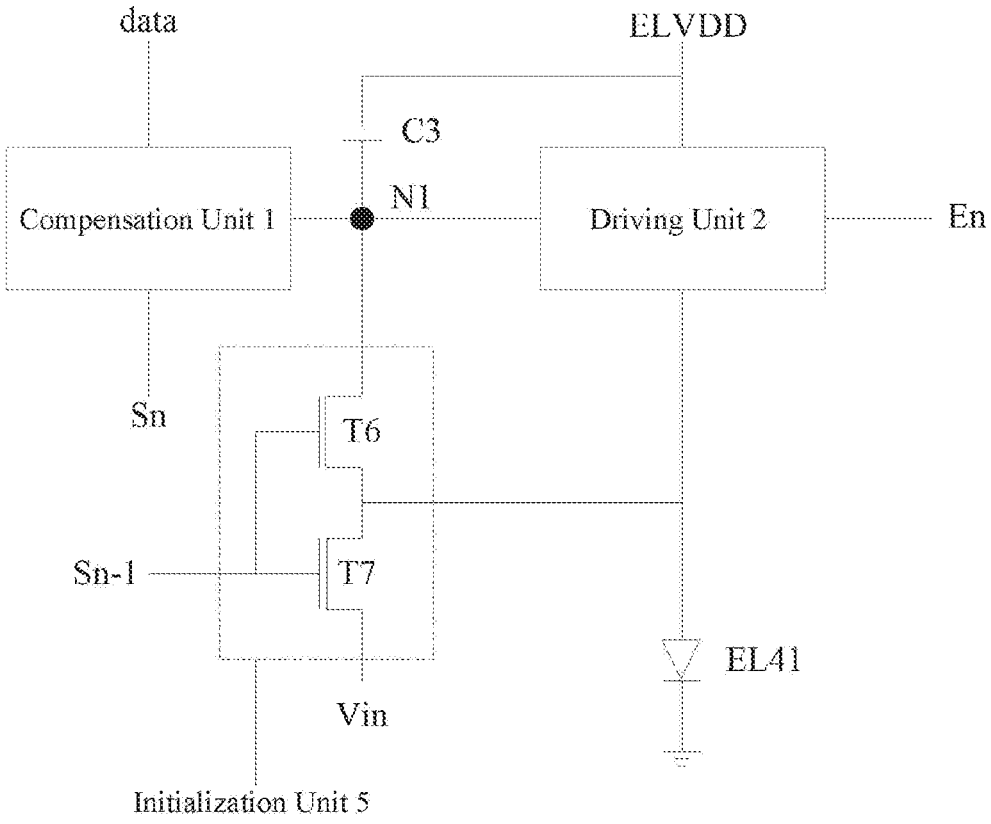
FIG. 4 is a schematic diagram of another pixel circuit according to an embodiment of the present disclosure.

Optionally, the second light emitting unit EL42 in FIG. 3 may also be the first light emitting unit EL41 of the pixel circuit shown in FIG. 3, that is, the initialization unit is electrically connected with the EL41. FIG. 4 is a schematic diagram of another pixel circuit according to an embodiment of the present disclosure. As shown in FIG. 4, the first electrode of the first initialization transistor T6 is electrically connected to the first node N1, and the gate electrode of the first initialization transistor T6 is externally connected to the second scan signal Sn-1. The second electrode of the first initialization transistor T6 is electrically connected to the first light emitting cell EL41. The first electrode of the second initialization transistor T7 is electrically connected to the first light emitting cell EL41. The second electrode of the second initialization transistor T7 is externally connected to the initialization voltage Vin, and the gate electrode of the second initialization transistor T7 is connected to the second scan signal Sn-1. When the second scan signal Sn-1 controls the initialization unit 5, the first initialization transistor T6 and the second initialization transistor T7 are turned on. Through the initialization voltage Vin, the first node N1 and the first light emitting unit EL41 are initialized.

Figure 5:
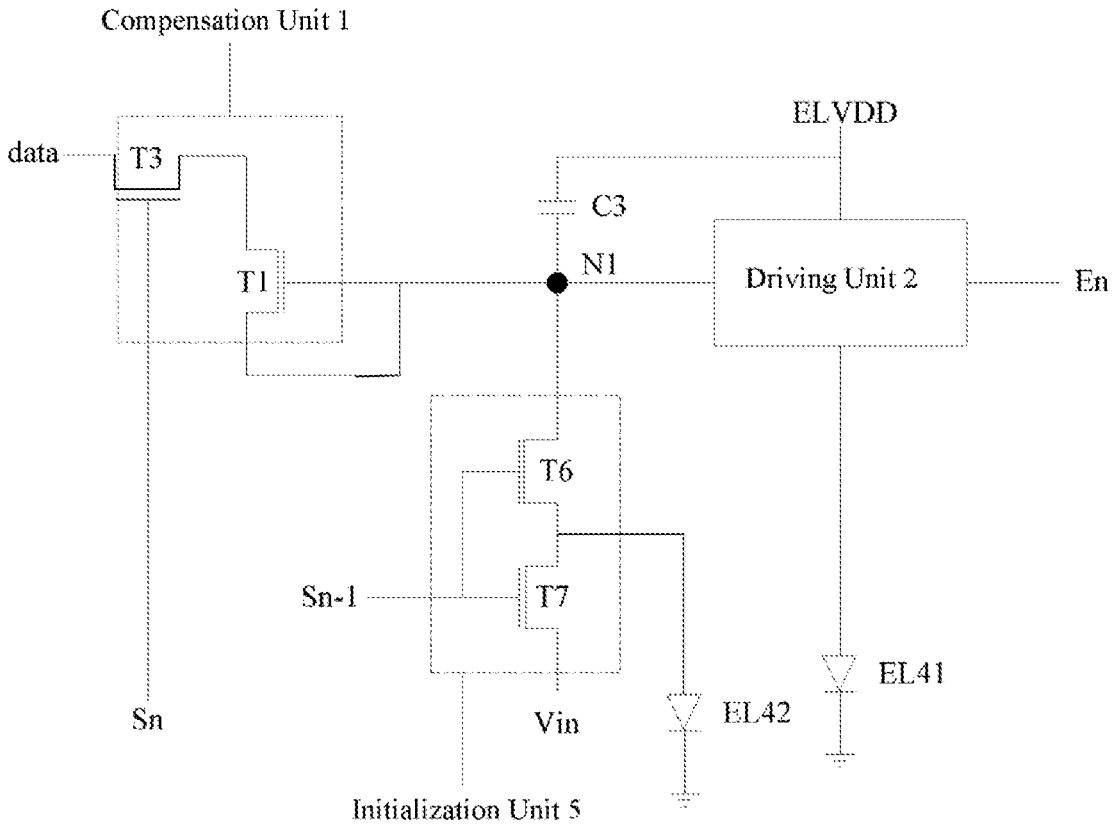
FIG. 5 is a schematic diagram of a compensation unit according to an embodiment of the present disclosure.

Optionally, an embodiment of the present disclosure further provides an implementation of a compensation unit. As shown in FIG. 5 is a schematic diagram of a compensation unit according to an embodiment of the present disclosure. As shown in FIG. 5, the compensation unit 1 includes a data strobe transistor T3 and the compensation transistor T1. A first electrode of the data strobe transistor T3 is electrically connected to the second electrode of the compensation transistor T1. A second electrode of the data strobe transistor T3 is externally connected to the data signal data. A gate electrode of the data strobe transistor T3 is externally connected to the first scan signal Sn. The first electrode of the compensation transistor T1 is electrically connected to the gate electrode of the compensation transistor T1, and the gate electrode of the compensation transistor T1 is electrically connected to the driving unit 2 through the first node N1. When the first scan signal Sn controls the data strobe transistor to be turned on, the compensation unit 1 is turned on, the compensation transistor T1 sets the voltage of the first node N1 to the first voltage, i.e. ($V_{data}+V_{thT1}$).

Figure 6:
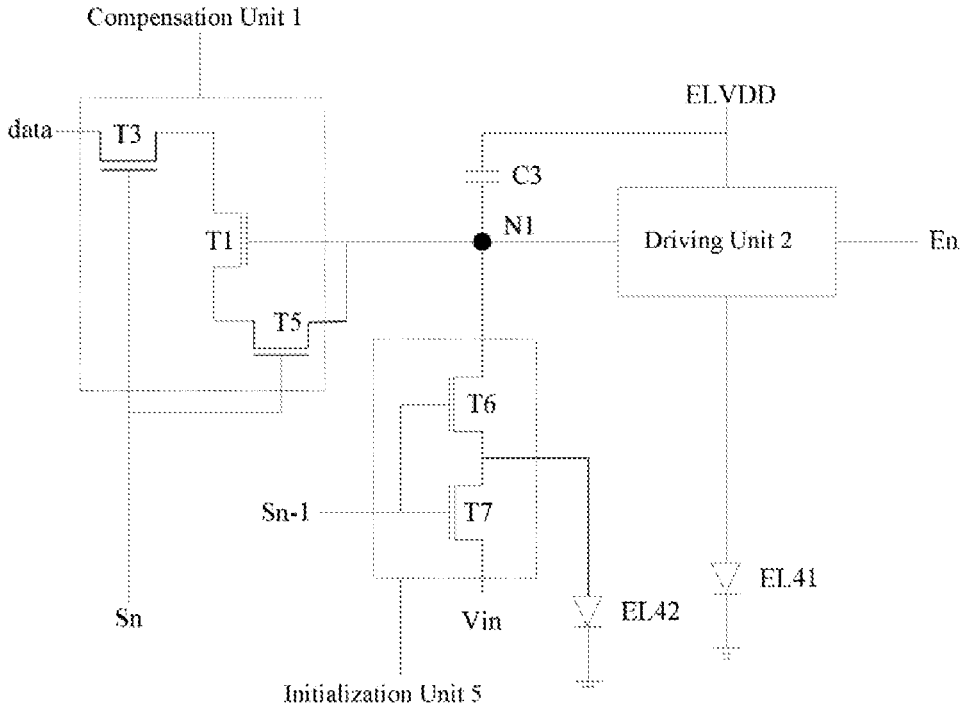
FIG. 6 is a schematic diagram of another compensation unit according to an embodiment of the present disclosure.

Optionally, the compensation unit further includes a switch transistor. FIG. 6 is a schematic diagram of another compensation unit according to an embodiment of the present disclosure. As shown in FIG. 6, the compensation unit 1 further includes a switch transistor T5. A first electrode of the switch transistor T5 is electrically connected to the gate electrode of the compensation transistor T1. A second electrode of the switch transistor T5 is electrically connected to the first electrode of the compensation transistor T1. A gate electrode of the switch transistor T5 is externally connected to the first scan signal Sn. When the first scan signal Sn turns on the switch transistor T5, the compensation transistor T1 starts to write the data signal data into the first node N1.

Figure 7:
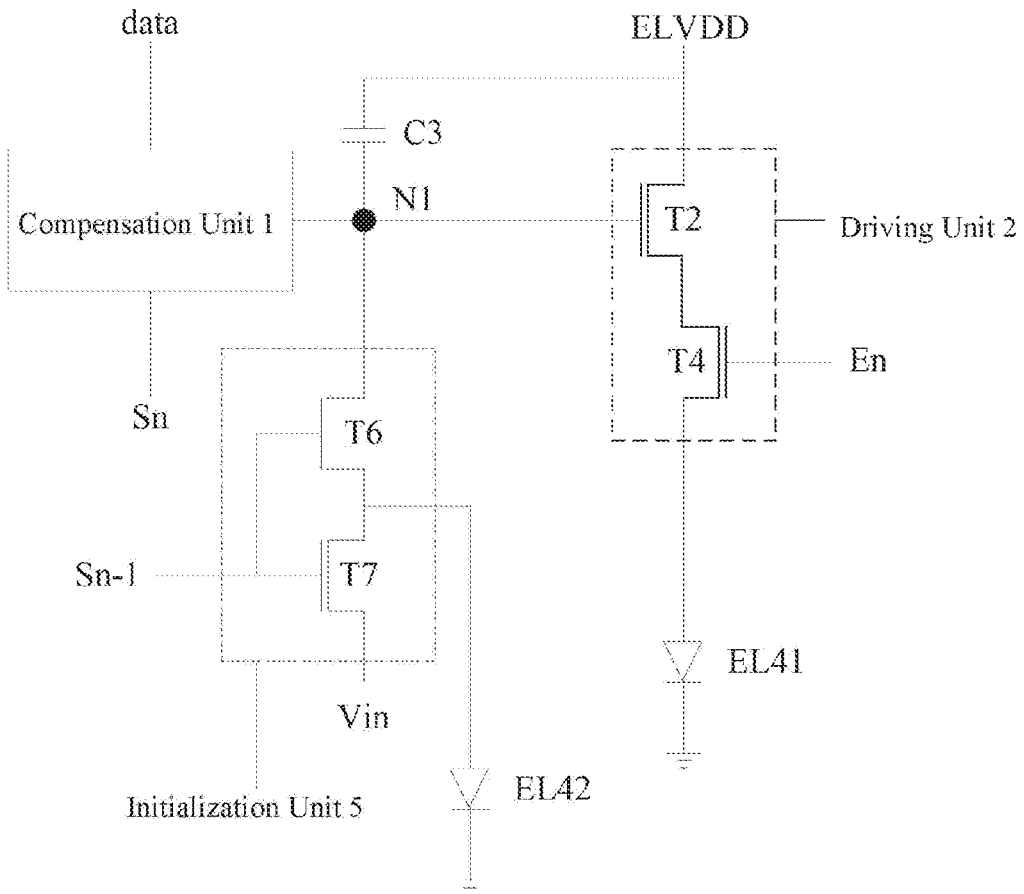
FIG. 7 is a schematic diagram of a driving unit according to an embodiment of the present disclosure.

Optionally, an embodiment of the present disclosure further provides an implementation of a driving unit. As shown in FIG. 7 is a schematic structural diagram of a driving unit according to an embodiment of the present disclosure. In FIG. 7, the driving unit 2 includes a driving transistor T2 and a light emitting control transistor T4. A first electrode of the driving transistor T2 is externally connected to the first power supply ELVDD. A gate electrode of the driving transistor T2 is electrically connected to the compensation unit 1. A second electrode of the driving transistor T2 is electrically connected to the first electrode of the light emitting control transistor T4. A second electrode of T4 is electrically connected to the first light emitting unit EL41. A gate electrode of the light emitting control transistor T4 is externally connected to the first control signal En. When En turns on the light emitting control transistor T4, the driving transistor T2 generates a driving current according to the gate voltage and the external power supply ELVDD. The driving current is input to the light emitting unit EL41 through the light emitting control transistor T4 and drives the EL41 to emit light.

Figure 8:
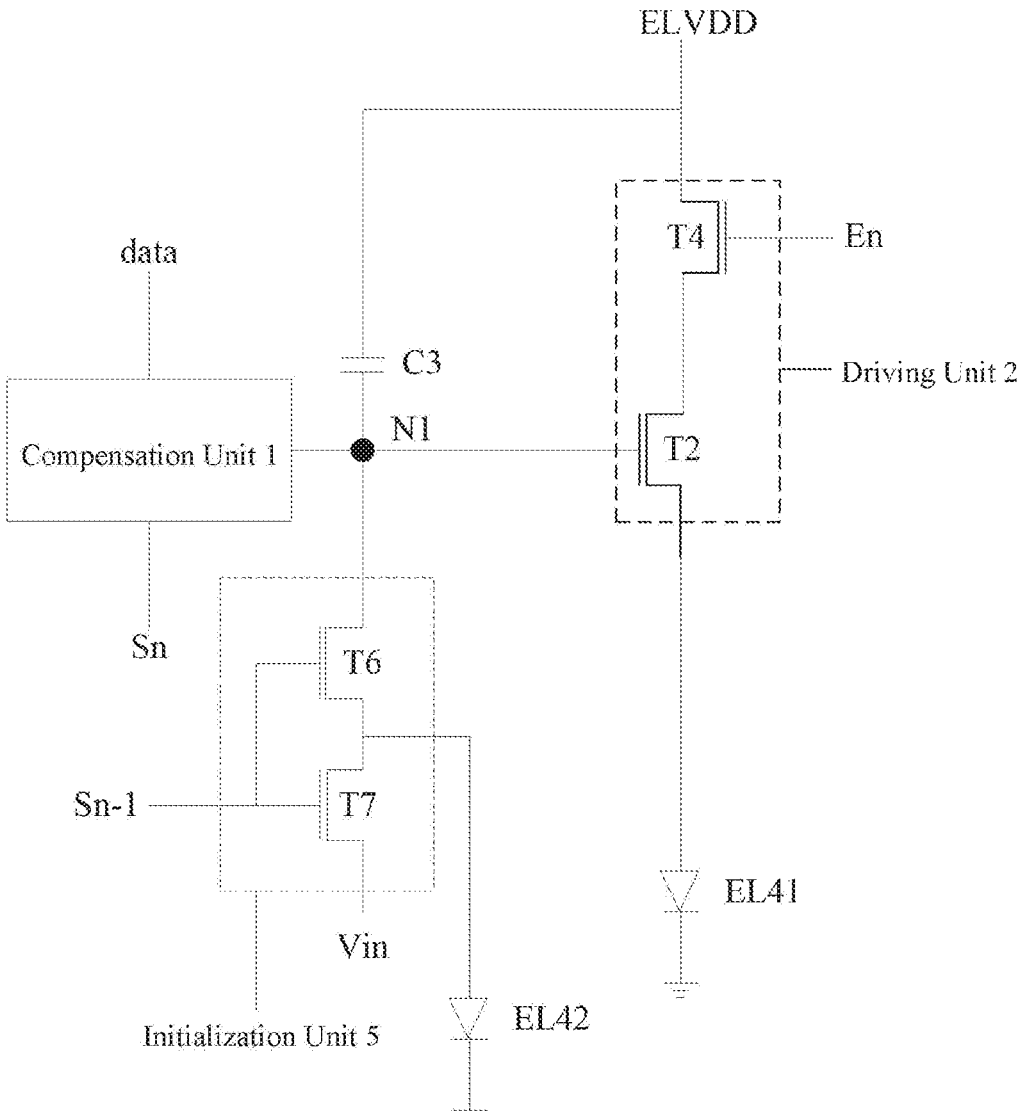
FIG. 8 is a schematic diagram of another driving unit according to an embodiment of the present disclosure.

Optionally, an embodiment of the present disclosure further provides another implementation for the driving unit. As shown in FIG. 8 is a schematic diagram of another driving unit according to an embodiment of the present disclosure. In FIG. 8, the driving unit 2 includes a driving transistor. T2 and a light emitting control transistor T4. The first electrode of the light emitting control transistor T4 is externally connected to the first power source ELVDD. The second electrode of the light emitting control transistor T4 is electrically connected to the first electrode of the drive transistor T2, and the gate electrode of the light emitting control transistor T4 is externally connected to the first control signal En. The gate electrode of the driving transistor T2 is electrically connected to the compensation unit 1, the second electrode of the driving transistor T2 is electrically connected to the first light emitting unit EL41. When En turns on the light emitting control transistor T4. The external power source ELVDD is connected with the first electrode of the driving transistor T2 via the light emitting control transistor T4 and the driving transistor T2. The driving transistor T2 generates a driving current according to the gate voltage and the external power source ELVDD, and the driving current is input into the light emitting unit EL41 through the light emitting control transistor to drive EL41 to emit light.

In summary, an embodiment of the present disclosure provides a pixel circuit including a compensation unit, a driving unit, a first light emitting unit, a second light emitting unit, an initialization unit, a capacitor and an external power supply. The compensation unit is electrically connected to the driving unit through the first node. The external power supply, the driving unit and the first light emitting unit are sequentially connected in series. The capacitor is disposed between the first node and the external power supply. The initialization unit includes a first initialization transistor and a second initialization transistor. The first electrode of the first initialization transistor and the first node is electrically connected, the gate electrode of the first initialization transistor is externally connected to the second scan signal, the second electrode of the first initialization transistor is electrically connected to the second light emitting unit, and the first electrode of the second initialization transistor is electrically connected to the second light emitting unit. The second electrode of the initialization transistor is externally connected to an initialization voltage, and the gate electrode of the second initialization transistor is connected to the second scan signal; the first initialization transistor and the second initialization transistor are a dual-gate transistor; and the compensation unit is externally connected to the data signal and the first scan signal. The compensation unit is configured to set the voltage of the first node as the first voltage under the effect of the first scan signal. The first voltage is resulted from the voltage of the data signal being compensated by a compensation transistor in the compensation unit. The capacitor is configured to maintain the voltage of the first node at the first voltage. The driving unit is externally connected to a first control signal, and the driving unit is configured to generate a driving current to drive the light emitting unit to emit light according to the first control signal. The driving current is obtained according to the first voltage, an external power supply and a threshold voltage of a driving transistor in the driving unit. The driving transistor and the compensation transistor are a common-gate transistor. The initialization unit is configured to turn on the first initialization transistor and the second initialization transistor under the control of the second scan signal, and initialize the first node and the second light emitting unit with the initialization voltage. The compensation unit is externally connected to the data signal, and the driving unit is externally connected to the external power source, so that in the data writing stage, the data signal is compensated by the compensation transistor in the compensation unit, and the threshold voltage of the compensation transistor is compensated to the voltage of the data signal to obtain the first voltage. Since the compensation unit is not connected to the external power supply, the influence of the external power supply on the data signal can be avoided. Moreover, the driving transistor and the compensation transistor are a common-gate transistor, and both have the same change in threshold voltage. Therefore, compensating the threshold voltage of the compensation transistor to the data signal is equivalent to compensating the threshold voltage of the driving transistor to the voltage of the data signal. This can ensure the threshold compensation function of the pixel circuit. Therefore, in the embodiments of the present disclosure, the threshold compensation function of the pixel circuit can be achieved while the e influence of the external power supply on the data signal can be avoided, thus improving the light emitting stability of the light-emitting diode. In addition, in the initialization unit, the first initialization transistor and the second initialization transistor are a dual-gate transistor, instead of two initialization transistor, thereby simplifying the circuit configuration and reducing the cost for the circuit.

Based on the same technical idea, an embodiment of the present disclosure further provides a driving method for a pixel circuit, for driving a pixel circuit provided by the embodiment of the present disclosure. FIG. 9 is a flowchart of a driving method for a pixel circuit according to an embodiment of the present disclosure. As shown in FIG. 9, the method includes the following steps.

In S901, in an initialization stage, the second scan signal is controlled to turn on the first initialization transistor and the second initialization transistor. The first initialization transistor initializes the first node with an initialization voltage, the second initialization transistor initializes the second light emitting unit with the initialization voltage. The capacitor maintains the initialization voltage. The first scan signal is controlled to turn off the compensation unit and the first control signal is controlled to turn off the driving unit.

In S902, in a data writing stage, the first scan signal is controlled to turn on the compensation unit, and the compensation unit sets the voltage of the first node to the first voltage; and the first control signal is controlled to turn off the driving unit, and the first light emitting unit does not emit light. The second scan signal is controlled to turn off the first initialization transistor and the second initialization transistor; the capacitor maintains the voltage of the first node at the first voltage; wherein, the first voltage is resulted from the voltage of the data signal being compensated by a compensation transistor in the compensation unit.

In S903, in a light emitting stage, the first scan signal is controlled to turn off the compensation unit; the second scan signal is controlled to turn off the first initialization transistor and the second initialization transistor, and the first control signal is controlled to turn on the driving unit. The driving unit generates a driving current to drive the first light emitting unit to emit light; the driving current is obtained based on the first voltage, the external power supply, and the threshold voltage of the driving transistor in the driving unit; and the capacitor is in the maintaining state.

Figure 10:
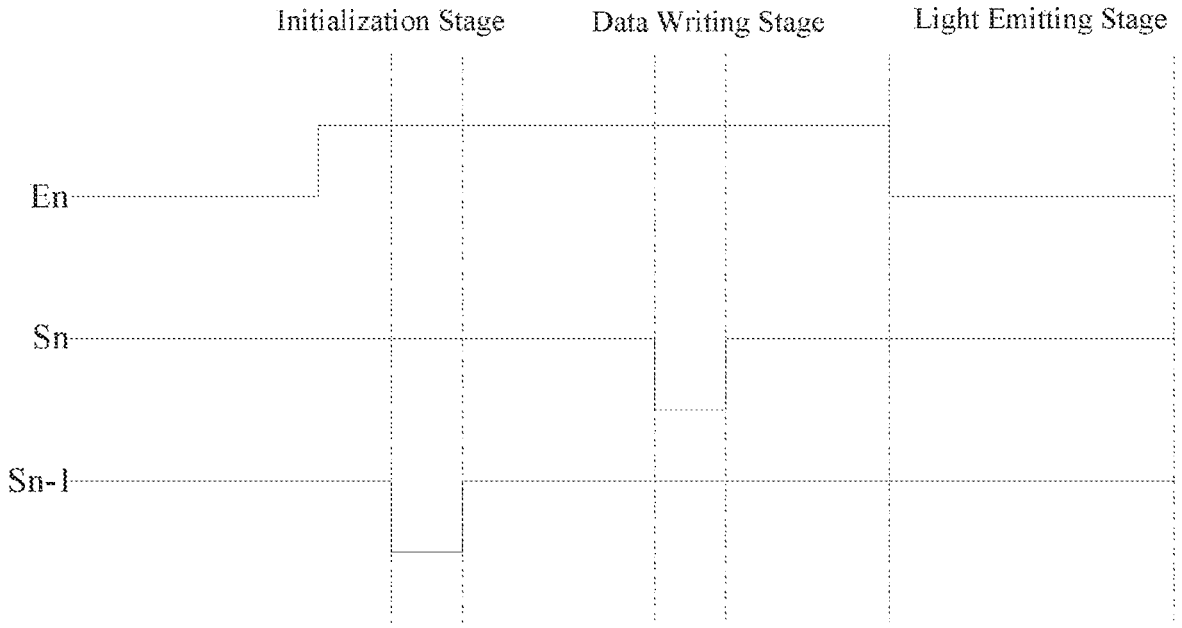
FIG. 10 is a schematic diagram of a driving signal according to an embodiment of the present disclosure.

During specific implementation of the above embodiment, the pixel circuit as shown in FIG. 3 can be driven. FIG. 10 is a schematic diagram of a driving signal according to an embodiment of the present disclosure. The driving signal in FIG. 10 includes a first scan signal Sn, a second scan signal Sn-1, and a first control signal En, and FIG. 10 illustrates a timing sequence of the first scan signal Sn, the second scan signal Sn-1, and the first control signal En when the transistor shown in the circuit of FIG. 3 is a PMOS (Positive channel Metal Oxide Semiconductor) transistor.

During the initialization stage, the second scan signal Sn-1 is at a low level, the first initialization transistor T6 and the second initialization transistor T7 are turned on, and the first initialization transistor T6 and the second initialization transistor T7 initialize the first node N1 and the second light emitting unit EL42 with the initialization voltage Vin. The capacitor C3 maintains the initialization voltage Vin. The first scan signal Sn is at a high level and the compensation unit 1 is turned off. The first control signal En is at a high level and the driving unit 2 is turned off.

In the data writing stage, as shown in FIG. 10, the first scan signal Sn is at a low level, the compensation unit 1 is turned on, the first control signal En is at a high level, the driving unit 2 is turned off, and the second scan signal Sn-1 is at a high level. The first initialization transistor T6 and the second initialization transistor T7 are turned off. The compensation unit 1 writes the data signal data to the first node N1, and the capacitor C3 starts charging until the voltage of the first node N1 is set to the first voltage ($V_{data}+V_{thT1}$). After that, the compensation transistor in the compensation unit 1 is turned off, and the capacitor C3 maintains the voltage of the first node N1 at the first voltage ($V_{data}+V_{thT1}$).

In the light emitting stage, as shown in FIG. 10, the first scan signal Sn is at a high level, the compensation unit 1 is turned off, the second scan signal Sn-1 is at a high level, and the first initialization transistor T6 and the second initialization transistor T7 are turned off. The first control signal En is at a low level and the driving unit 2 is turned on. The driving unit 2 generates a driving current to drive the light emitting unit EL4 to emit light. Since the voltage of the first node is the first voltage ($V_{data}+V_{thT1}$), which compensates the threshold of the gate voltage of the driving transistor in the driving unit 2, so that the driving current is no longer affected by the threshold drift of the driving transistor.

In order to solve the problems that light emission of the light emitting diode is unstable and the circuit has low safety in the related art, the embodiments of the present disclosure are further optimized on the basis of the existing threshold compensation circuit. It can avoid the influence of the external power supply on the data signals and make light emission of the light emitting diode more stable. The following are some implementations taking PMOS as example. It should be pointed out that the following variations of specific implementations, such as variations of NMOS or COMS circuits also fall within the scope of protection of the embodiments of the present disclosure. The present application does not enumerate all the variations of the pixel circuits, and only illustrate some of the pixel circuits to explain the technical solutions disclosed in the embodiments of the present disclosure.

Embodiment 1

Figure 11:
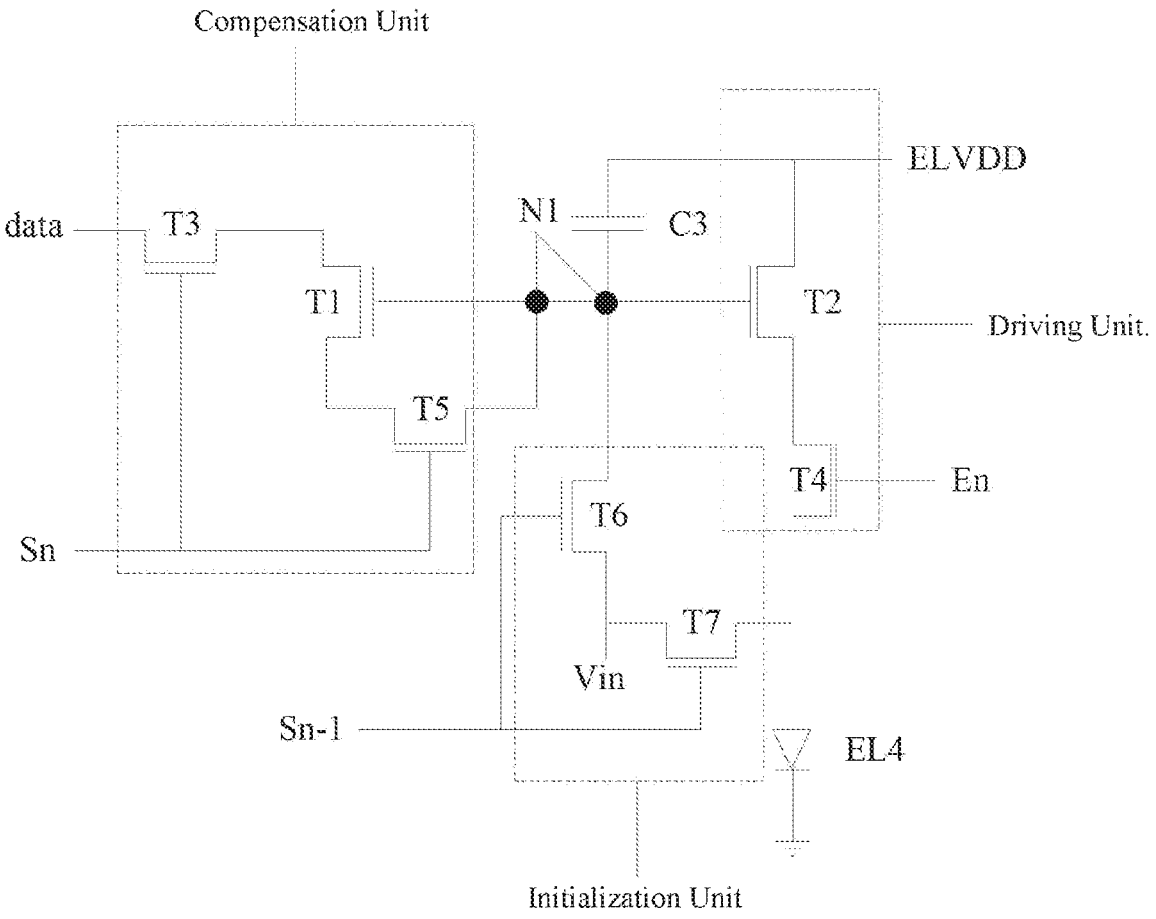
FIG. 11 illustrates one implementation of a pixel circuit according to an embodiment of the present disclosure.

FIG. 11 illustrates one implementation of a pixel circuit according to an embodiment of the present disclosure. As shown in FIG. 11, the compensation unit includes a data strobe transistor T3, a compensation transistor T1, and a switch transistor T5. The driving unit includes a driving transistor T2 and a light emitting control transistor T4. The initialization unit includes an initialization transistor T6 and a second initialization transistor T7.

In the compensation unit, the drain electrode of the data strobe transistor T3 is electrically connected to the source electrode of the compensation transistor T1; the source electrode of the data strobe transistor T3 is electrically connected to the data signal data; the gate electrode of the data strobe transistor T3 and the first scan signal Sn is electrically connected; the gate electrode of the compensating transistor T1 is electrically connected to the gate electrode of the driving transistor T2 through the first node N1; and the drain electrode of the compensating transistor T1 is electrically connected to the source electrode of the switch transistor T5. The drain electrode of the switch transistor T5 is electrically connected to the gate electrode of the compensation transistor T1, and the gate electrode of the switch transistor T5 is electrically connected to the first scan signal Sn.

In the driving unit, the source electrode of the driving transistor T2 is externally connected to the external power supply ELVDD; the drain electrode of the driving transistor T2 is electrically connected to the source electrode of the light emitting control transistor T4; the drain electrode of the light emitting control transistor T4 is electrically connected to the light emitting unit EL4, and the gate electrode of the light emitting control transistor T4 is externally connected to the first control signal En.

In the initialization unit, the drain electrode of the first initialization transistor T6 is electrically connected to the first node N1; the gate electrode of the first initialization transistor T6 is externally connected to the second scan signal Sn-1; the source electrode of the first initialization transistor T6 is electrically connected to the second light emitting unit EL42; the drain electrode of the second initialization transistor T7 is electrically connected to the second light emitting unit EL42; the source electrode of the second initialization transistor T7 is connected to the initialization voltage Vin; and the gate electrode of the second initialization transistor T7 is externally connected to the second scan signal Sn-1. The first initialization transistor T6 and the second initialization transistor T7 are a dual-gate transistor.

The capacitor C3 is disposed between the first node N1 and the external power supply ELVDD.

According to the driving signal shown in FIG. 10, the driving method of the pixel circuit shown in FIG. 11 is as follows.

During the initialization stage, the first scan signal Sn is at a high level, causing the data strobe transistor T3 and the switch transistor T5 to be turned off and the compensation unit to be turned off. The first control signal En is at a high level, causing the light emitting control transistor T4 to be turned off and the driving unit to be turned off. The second control signal Sn-1 is at a low level, causing the first initialization transistor T6 and the second initialization transistor T7 to be turned on. The T6 transfers the initializing voltage to the first node N1 so as to initialize the first node N1. T7 transfers the initializing voltage Vin to the light emitting unit EL4, thereby initializing the light emitting unit EL4.

In the data writing stage, the first scan signal Sn is at a low level, causing the data strobe transistor T3 and the switch transistor T5 to be turned on and the compensation unit to be turned on. The first control signal En is at a high level, causing the light emitting control transistor T4 to be turned off and the driving unit to be turned off. The second scan signal Sn-1 is at a high level, causing the first initialization transistor T6 and the second initialization transistor T7 to be turned off, and the initialization unit to be turned off. The data signal data arrives at the source electrode of the compensation transistor T1 via the data strobe transistor T3. Since the switch transistor T5 is turned on, the compensation transistor T1 operates in the saturation region, and the data signal data is written into the first node N1 until the voltage of the first node N1 reaches the first voltage ($V_{data}+V_{thT1}$), and the compensation transistor T1 is turned off.

In the light emitting stage, the first scan signal Sn is at a high level, causing the data strobe transistor T3 and the switch transistor T5 to be turned off and the compensation unit to be turned off. The first control signal En is at a low level, causing the light emitting control transistor T4 to be turned on and the driving unit to be turned on. The second scan signal Sn-1 is at a high level, causing the first initialization transistor T6 and the second initialization transistor T7 to be turned off, and the initialization unit to be turned off. The driving transistor T2 generates a driving current to drive the light emitting unit EL4 to emit light. Since the voltage of the first node is the first voltage ($V_{data}+V_{thT1}$), which compensates the threshold of the gate voltage of the driving transistor, so that the driving current is no longer affected by the threshold drift of the driving transistor T2.

Embodiment 2

Figure 12:
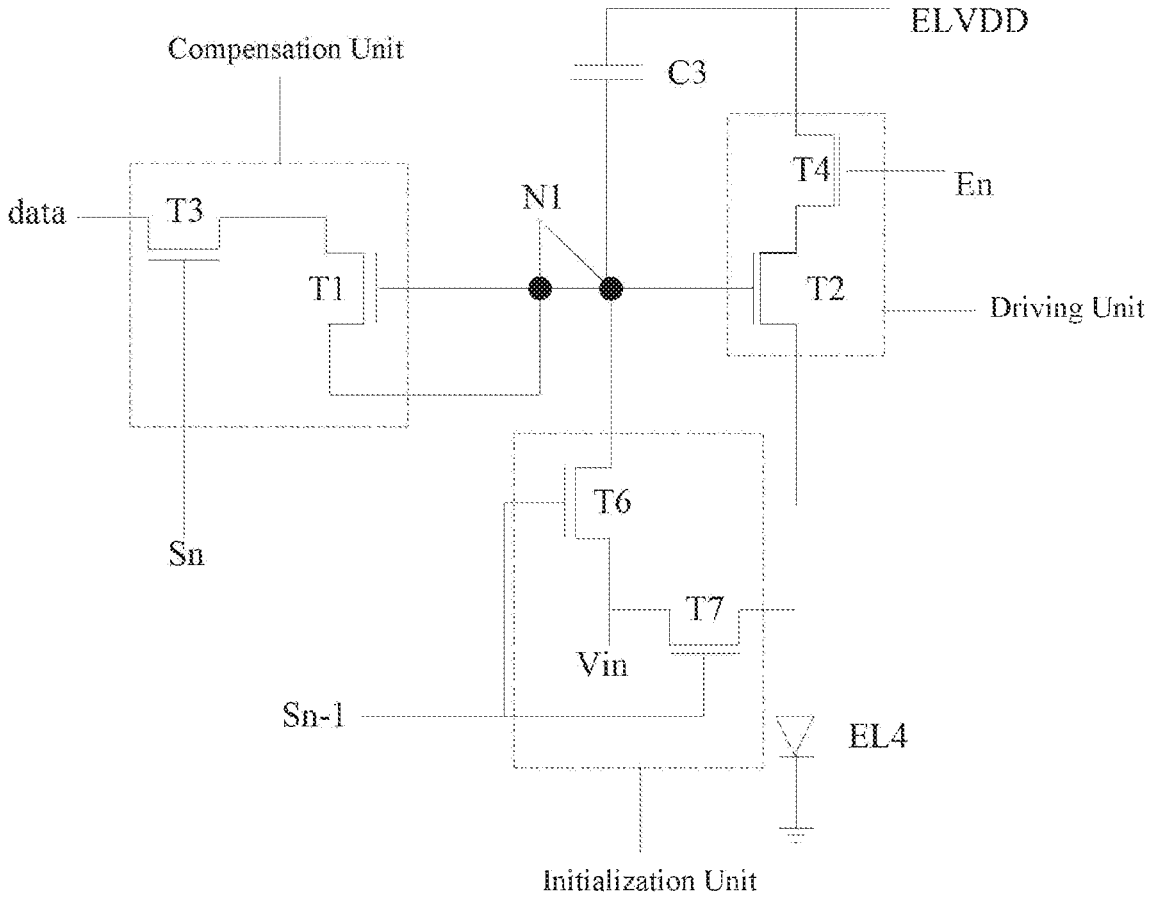
FIG. 12 illustrates one implementation of a pixel circuit according to an embodiment of the present disclosure.

FIG. 12 shows one implementation of a pixel circuit according to an embodiment of the present disclosure. As shown in FIG. 12, the compensation unit includes a data strobe transistor T3 and a compensation transistor T1. The driving unit includes a driving transistor T2 and a light emitting control transistor T4. The initialization unit includes a first initialization transistor T6 and a second initialization transistor T7.

In the compensation unit, the drain electrode of the data strobe transistor T3 is electrically connected to the source electrode of the compensation transistor T1; the source electrode of the data strobe transistor T3 is electrically connected to the data signal data; and the gate electrode of the data strobe transistor T3 is electrically connected to the first scan signal Sn; the gate electrode of the compensating transistor T1 is electrically connected to the gate electrode of the driving transistor T2 through the first node N1; and the drain electrode of the compensating transistor T1 is electrically connected to the gate electrode of the compensating transistor T1.

In the driving unit, the source electrode of the driving transistor T2 is externally connected to the n external power supply ELVDD; the drain electrode of the driving transistor T2 is electrically connected to the source electrode of the light emitting control transistor T4; the drain electrode of the light emitting control transistor T4 is electrically connected to the light emitting unit EL4; and the gate electrode of the light emitting control transistor T4 is externally connected to the first control signal En.

In the initialization unit, the source electrode of the first initialization transistor T6 is connected to the initialization voltage Vin; the drain electrode of the first initialization transistor T6 is electrically connected to the first node N1; the gate electrode of the first initialization transistor T6 is electrically connected to the second scan signal Sn-1; the source electrode of the second initialization transistor T7 is externally connected to the initialization voltage Vin; the drain electrode of the second initialization transistor T7 is electrically connected to the light emitting unit EL4; and the gate electrode of the second initialization transistor T7 is electrically connected to the second scan signal Sn-1.

The capacitor C3 is disposed between the first node N1 and the external power supply ELVDD.

According to the driving signal shown in FIG. 10, the driving method of the pixel circuit shown in FIG. 12 is as follows.

During the initialization stage, the first scan signal Sn is at a high level, causing the data strobe transistor T3 to be turned off and the compensation unit to be turned off. The first control signal En is at a high level, causing the light emitting control transistor T4 to be turned off and the driving unit to be turned off. The second control signal Sn-1 is at a low level, causing the first initialization transistor T6 and the second initialization transistor T7 to be turned on. T6 transfers the initializing voltage to the first node N1 so as to initialize the first node N1. T7 transfers the initializing voltage Vin to the light emitting unit EL4, so as to initialize the light emitting unit EL4.

In the data writing stage, the first scan signal Sn is at a low level, causing the data strobe transistor T3 to be turned on and the compensation unit to be turned on. The first control signal En is at a high level, causing the light emitting control transistor T4 to be turned off and the driving unit to be turned off. The second scan signal Sn-1 is at a high level, causing the first initialization transistor T6 and the second initialization transistor T7 to be turned off, and the initialization unit to be turned off. The data signal data reaches the source electrode of the compensation transistor T1 via the data strobe transistor T3. Since the drain and the gate electrodes of the compensation transistor T1 are short-circuited, the compensation transistor T1 operates in the saturation region, the data signal data is written into the first node N1 until the voltage of a node N1 reaches the first voltage ($V_{data}+V_{thT1}$) and after that, the compensation transistor T1 is turned off.

In the light emitting stage, the first scan signal Sn is at a high level, causing the data strobe transistor T3 to be turned off and the compensation unit to be turned off. The first control signal En is at a low level, causing the light emitting control transistor T4 to be turned on and the driving unit to be turned on. The second scan signal Sn-1 is at a high level, causing the first initialization transistor T6 and the second initialization transistor T7 to be turned off, and the initialization unit to be turned off. The driving transistor T2 generates a driving current to drive the light emitting unit EL4 to emit light. Since the voltage of the first node is the first voltage ($V_{data}+V_{thT1}$), the threshold of the gate voltage of the driving transistor can be compensated so that the driving current is no longer affected by the threshold drift of the driving transistor T2.

Figure 13:
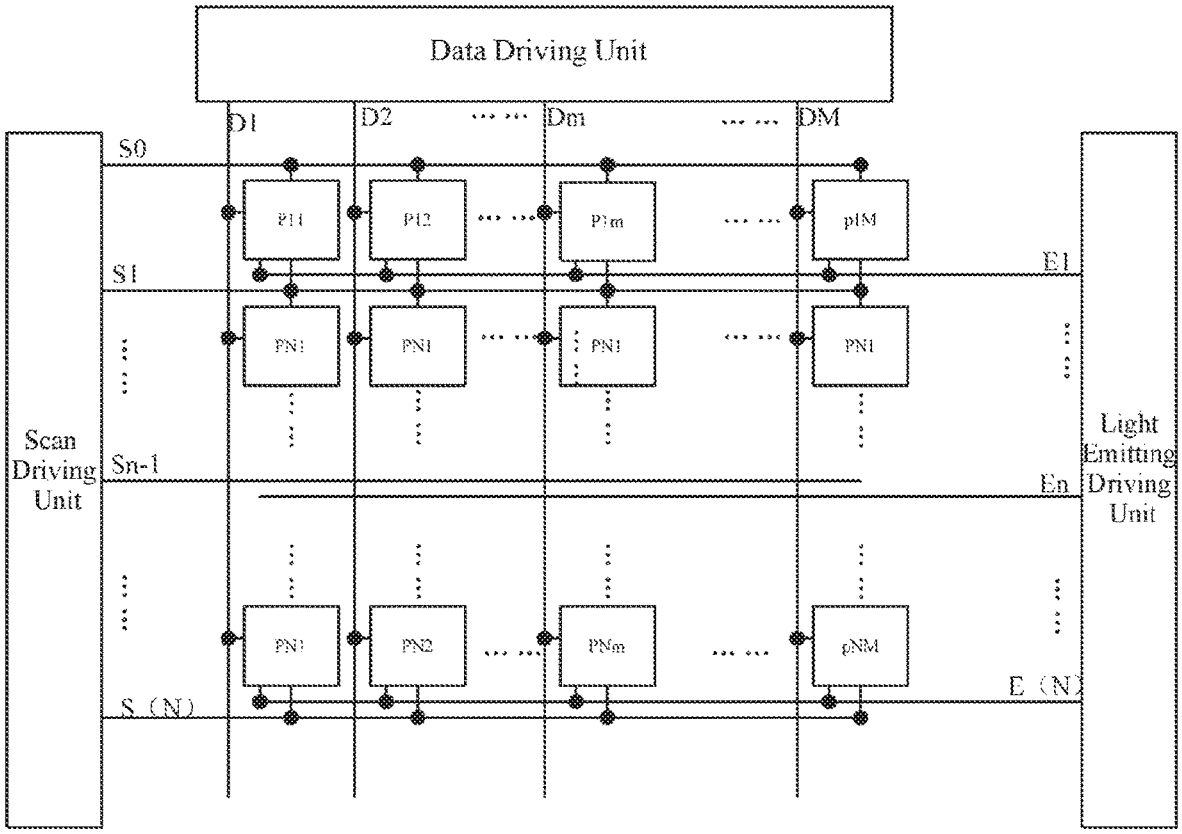
FIG. 13 is a schematic diagram of a display provided by an embodiment of the present disclosure.

Based on the same technical idea, an embodiment of the present disclosure further provides a display, which includes the pixel circuit disclosed in any one of the above embodiments. FIG. 13 is a schematic diagram of a display provided by an embodiment of the present disclosure. In FIG. 13, a display includes: a N×M pixel circuit array, a scan driving unit for generating scan signals S0, S1, S2, . . . , SN, where Sn is the scan signal of the $n^{th}$ row of pixels and n=1, 2, . . . N; a data driving unit for generating the data signal data, including a number M of data signals of D1, D2 . . . DM, respectively corresponding to the M columns of pixels; Dm is the data signal for the $m^{th}$ column of pixels, where m=1, 2, . . . M; a light emitting driving unit for generating the first control signals E1, E2, . . . EN, where En is the first control signal input to the n'h row of pixels by the light emitting driving unit, where n=1, 2 . . . N.

In summary, an embodiment of the present disclosure provides a pixel circuit, a driving method and a display. The pixel circuit includes a compensation unit, a driving unit, a first light emitting unit, a second light emitting unit, an initialization unit, a capacitor and an external power supply. The compensation unit is electrically connected to the driving unit through the first node. The external power supply, the driving unit and the first light emitting unit are sequentially connected in series. The capacitor is disposed between the first node and the external power supply. The initialization unit includes a first initialization transistor and a second initialization transistor. The first electrode of the first initialization transistor and the first node is electrically connected, the gate electrode of the first initialization transistor is externally connected to the second scan signal, the second electrode of the first initialization transistor is electrically connected to the second light emitting unit, and the first electrode of the second initialization transistor is electrically connected to the second light emitting unit. The second electrode of the initialization transistor is externally connected to an initialization voltage, and the gate electrode of the second initialization transistor is connected to the second scan signal; the first initialization transistor and the second initialization transistor are a dual-gate transistor; and the compensation unit is externally connected to the data signal and the first scan signal. The compensation unit is configured to set the voltage of the first node as the first voltage under the effect of the first scan signal. The first voltage is resulted from the voltage of the data signal being compensated by a compensation transistor in the compensation unit. The capacitor is configured to maintain the voltage of the first node at the first voltage. The driving unit is externally connected to a first control signal, and the driving unit is configured to generate a driving current to drive the light emitting unit to emit light according to the first control signal. The driving current is obtained according to the first voltage, an external power supply and a threshold voltage of a driving transistor in the driving unit. The driving transistor and the compensation transistor are a common-gate transistor. The initialization unit is configured to turn on the first initialization transistor and the second initialization transistor under the control of the second scan signal, and initialize the first node and the second light emitting unit with the initialization voltage. The compensation unit is externally connected to the data signal, and the driving unit is externally connected to the external power source, so that in the data writing stage, the data signal is compensated by the compensation transistor in the compensation unit, and the threshold voltage of the compensation transistor is compensated to the voltage of the data signal to obtain the first voltage. Since the compensation unit is not connected to the external power supply, the influence of the external power supply on the data signal can be avoided. Moreover, the driving transistor and the compensation transistor are a common-gate transistor, and both have the same change in threshold voltage. Therefore, compensating the threshold voltage of the compensation transistor to the data signal is equivalent to compensating the threshold voltage of the driving transistor to the voltage of the data signal. This can ensure the threshold compensation function of the pixel circuit. Therefore, in the embodiments of the present disclosure, the threshold compensation function of the pixel circuit can be achieved while the e influence of the external power supply on the data signal can be avoided, thus improving the light emitting stability of the light-emitting diode. In addition, in the initialization unit, the first initialization transistor and the second initialization transistor are a dual-gate transistor, instead of two initialization transistor, thereby simplifying the circuit configuration and reducing the cost for the circuit.

Although the preferred embodiments of the present disclosure have been described, those skilled in the art can make additional alterations and modifications to these embodiments from the knowledge of the basic inventive concept. Therefore, the appended claims are intended to be interpreted as including the preferred embodiments and all changes and modifications that fall within the scope of the present disclosure.

It will be apparent to those skilled in the art that various modifications and variations can be made in the present disclosure without departing from the spirit and scope of the present disclosure. Thus, if these modifications and variations of the present disclosure fall within the scope of the claims of the present disclosure and their equivalents, the present disclosure is also intended to include these modifications and variations.

What is claimed is:

1. A pixel circuit, comprising: a compensation unit, a driving unit, a first light emitting unit, a second light emitting unit, an initialization unit, a capacitor, and an external power supply;

wherein the compensation unit is electrically connected to the driving unit through a first node; the external power supply, the driving unit, and the first light emitting unit are sequentially connected in series; the capacitor is disposed between the first node and the external power supply; the initialization unit comprises a first initialization transistor and a second initialization transistor, a first electrode of the first initialization transistor is electrically connected to the first node, and a gate electrode of the first initialization transistor is externally connected to a second scan signal, a second electrode of the first initialization transistor is electrically connected to the second light emitting unit, a first electrode of the second initialization transistor is electrically connected to the second light emitting unit, a second electrode of the second initialization transistor is externally connected to an initialization voltage, a gate electrode of the second initialization transistor is externally connected to the second scan signal, the first initialization transistor and the second initialization transistor are a dual-gate transistor;

the compensation unit is externally connected to the data signal and a first scan signal, and the compensation unit is configured to, under the effect of the first scan signal, set the voltage of the first node to a first voltage which is resulted from the voltage of the data signal being compensated by a compensation transistor in the compensation unit;

the capacitor is configured to maintain the voltage of the first node at the first voltage;

the driving unit is externally connected to a first control signal, the driving unit is configured to generate a driving current to drive the light emitting unit to emit light according to the first control signal, the driving current is obtained according to the first voltage, an external power supply and a threshold voltage of a driving transistor in the driving unit, and the driving transistor and the compensation transistor are a common-gate transistor; and the initialization unit is configured to turn on the first initialization transistor and the second initialization transistor under the control of the second scan signal, and initialize the first node and the second light emitting unit with the initialization voltage, wherein the compensation unit comprises a data strobe transistor, a compensation transistor and a switch transistor;

a first electrode of the data strobe transistor is electrically connected to a second electrode of the compensation transistor, a second electrode of the data strobe transistor is externally connected to the data signal, a gate electrode of the data strobe transistor is externally connected to the first scan signal, a first electrode of the compensation transistor is electrically connected to a gate electrode of the compensation transistor, and a gate electrode of the compensation transistor is electrically connected to the driving unit through the first node;

a first electrode of the switch transistor is electrically connected to a gate electrode of the compensation transistor and a gate electrode of the driving transistor, a second electrode of the switch transistor is electrically connected to a first electrode of the compensation transistor, and a gate electrode of the switch transistor is externally connected to the first scan signal, and the switch transistor is configured to turn on or turn off the compensation transistor according to the first scan signal;

the compensation unit is configured to turn on the data strobe transistor through the first scan signal, so that the compensation transistor sets the voltage of the first node to the first voltage which is resulted from the voltage of the data signal being compensated by a compensation transistor in the compensation unit.

2. The pixel circuit of claim 1, wherein the driving transistor and the compensation transistor are mirror transistors.

3. The pixel circuit of claim 1, wherein the second light emitting unit is a first light emitting unit of an adjacent pixel circuit.

4. A pixel circuit driving method applied to the pixel circuit according to claim 1, comprising:

in an initialization stage, controlling the second scan signal to turn on the first initialization transistor and the second initialization transistor, the first initialization transistor initializing the first node with the initialization voltage, the second initialization transistor initializing the second light emitting unit with the initialization voltage, the capacitor maintaining the initialization voltage, controlling the first scan signal to turn off the compensation unit and controlling the first control signal to turn off the driving unit;

in a data writing stage, controlling the first scan signal to turn on the compensation unit, and the compensation unit setting the voltage of the first node to the first voltage; controlling the first control signal to turn off the driving unit, so that the first light emitting unit does not emit light, controlling the second scan signal to turn off the first initialization transistor and the second initialization transistor; the capacitor maintaining the voltage of the first node at the first voltage; wherein, the first voltage is resulted from the voltage of the data signal being compensated by the compensation transistor in the compensation unit;

in a light emitting stage, controlling the first scan signal to turn off the compensation unit; controlling the second scan signal to turn off the first initialization transistor and the second initialization transistor, and controlling the first control signal to turn on the driving unit, the driving unit generating a driving current to drive the first light emitting unit to emit light; wherein the driving current is obtained based on the first voltage, the external power supply, and the threshold voltage of the driving transistor in the driving unit; and the capacitor is in the maintaining state.

5. The method of claim 4, wherein controlling the first scan signal to turn on the compensation unit comprises:

controlling the first scan signal to turn on the data strobe transistor or the switch transistor.

6. A display comprising a pixel circuit according to claim 1.

7. The display of claim 6, wherein the driving transistor and the compensation transistor are mirror transistors.

8. The display of claim 6, wherein the second light emitting unit is a first light emitting unit of an adjacent pixel circuit.

* * * * *